United States Patent [19]

Conkle

[11] Patent Number: 4,837,666

[45] Date of Patent: Jun. 6, 1989

[54] NIGHT LIGHT FOR WALKING ASSISTANCE DEVICES

[76] Inventor: Gary L. Conkle, Box 143, Harrod, Ohio 45850

[21] Appl. No.: 196,565

[22] Filed: May 20, 1988

[51] Int. Cl.[4] ..... A45B 3/02

[52] U.S. Cl. ..... 362/102; 135/65; 362/398

[58] Field of Search ..... 362/102, 398, 186; 135/65, 66, DIG. 10, DIG. 11

[56] References Cited

U.S. PATENT DOCUMENTS

| | | | |
|---|---|---|---|
| D. 140,581 | 3/1945 | Wagner . | |
| 754,631 | 3/1904 | Allen . | |
| 2,249,691 | 7/1941 | Gelardin | 362/186 |
| 2,259,443 | 10/1941 | Geier . | |
| 2,475,958 | 2/1948 | Goodrich | 362/398 |
| 4,583,080 | 4/1986 | DiVito et al. | 362/102 |

FOREIGN PATENT DOCUMENTS

| | | | |
|---|---|---|---|
| 62043 | 12/1913 | Switzerland | 362/102 |
| 101585 | 10/1916 | United Kingdom | 362/102 |

*Primary Examiner*—Ira S. Lazarus
*Assistant Examiner*—Sue Hagarman
*Attorney, Agent, or Firm*—Fleit, Jacobson, Cohn & Price

[57] ABSTRACT

A night light and more specifically an attachment for walking assistance devices such as a walking cane, crutches, walkers and the like. The night light is secured to the walking assistance device by the use of clamp devices or other attachment means and is provided with a battery operated light positioned to illuminate the surfaces and terrain being traversed by the person using the walking assistance device with the night light attached thereto. The night light includes a long throw toggle switch located in association with a handgrip, handle or the like on the walking assistance device to enable easy access to the toggle switch by the person using the walking assistance device.

5 Claims, 1 Drawing Sheet

NIGHT LIGHT FOR WALKING ASSISTANCE DEVICES

BACKGROUND OF THE INVENTION

Field of the Invention

The present invention generally relates to a night light and more specifically to an attachment for walking assistance devices such as a walking cane, crutches, walkers and the like. The night light is secured to the walking assistance device by the use of clamp devices or other attachment means and is provided with a battery operated light positioned to illuminate the surfaces and terrain being traversed by the person using the walking assistance device with the night light attached thereto. The night light includes a long throw toggle switch located in association with a handgrip, handle or the like on the walking assistance device to enable easy access to the toggle switch by the person using the walking assistance device.

INFORMATION DISCLOSURE STATEMENT

There has existed a problem of adequate lighting for a person using a walking cane, crutches, walker or the like especially when the person is moving from place-to-place at night or in areas where insufficient light exists to enable proper visual observation of the surface or terrain being traversed. Some efforts have been made to provide auxiliary illumination devices to assist in proper observation of the surfaces being traversed. However, the prior art does not include the specific structural features of the present invention.

SUMMARY OF THE INVENTION

An object of the present invention is to provide a night light for walking canes, crutches, walkers and the like for assisting in illuminating an area being traversed which enables the user of the present invention to more safely traverse the area since the surface or terrain of the area will be effectively illuminated by the night.

Another object of the invention is to provide a night light in accordance with the preceding object attached to the walking cane, crutches, walker, wheelchair or the like by clamp devices or other bracket structure with the night light including a long throw toggle switch on one end thereof located adjacent the handle or handgrip of the walking cane, crutches or walker so that the user can easily manipulate the switch for turning the light on or off.

A further object of the invention is to provide a night light in accordance with the preceding objects in which the light includes a light bulb with a transparent shield that faces downwardly to illuminate the area immediately in front of and adjacent to the point of contact of the cane, crutch or walker with the ground surface or other surface being traversed.

Still another object of the invention is to provide a night light in accordance with the preceding objects that includes a magnet to support the cane, crutch or walker in a desired relationship to a surface against which the cane, crutch or walker is positioned thereby retaining the device in accessible position.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
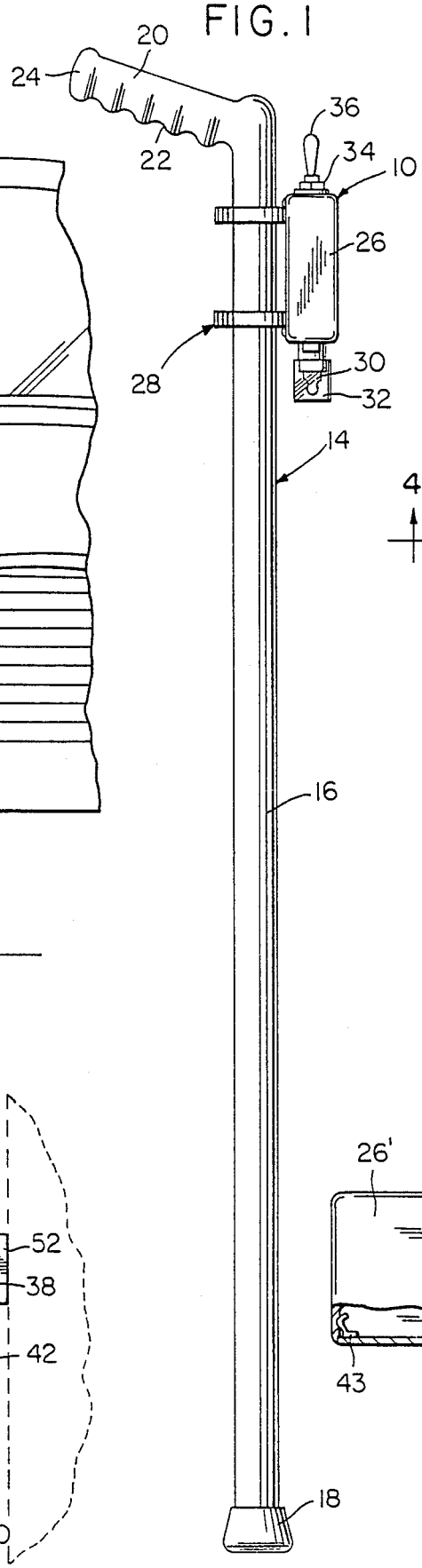
FIG. 1 is a side elevational view of the combination night light and walking cane of this invention.

The night light of the present invention is generally designated by reference numeral 10 and is illustrated in combination with a walking cane 14 in which the walking cane is conventional and provided with an elongated rod or standard 16 which may be of solid or hollow construction and may be constructed of various materials conventionally employed in constructing walking canes. The lower end of the standard 16 is provided with a tip 18 of resilient material and the upper end of the standard is provided with an upwardly inclined handle or handgrip 20 having finger receiving grooves 22 on the undersurface thereof and a knob 24 at the free end thereof. While this type of walking cane has been illustrated, the night light 10 can be associated with various types of conventional walking canes and may also be attached to a crutch or crutches, a walker, wheelchair or other walking assistance devices.

The night light 10 includes a hollow parallelopiped housing 26 supported on the walking cane 14 by a pair of spaced clamp members 28 and provided with a light bulb 30 located at the lower end thereof which is provided with a cylindrical transparent shield 32. The light bulb is conventional and is replaceable and the transparent shield 32 is of substantially rigid plastic material that has an open lower end generally aligned with the lower tip end of the light bulb to enable the light bulb to be changed. The upper end of the shield 32 is detachably mounted on or permanently bonded to the light bulb socket by any suitable bonding agent such as glue or any suitable type of connection may be provided between the transparent shield 32 and the housing 26. As illustrated, when the housing 26 is mounted on the cane 14, it generally is parallel to the elongated standard 16 and directs light downwardly toward the tip 18 and the ground surface or other supporting surface or terrain with which it engages.

Figure 2:
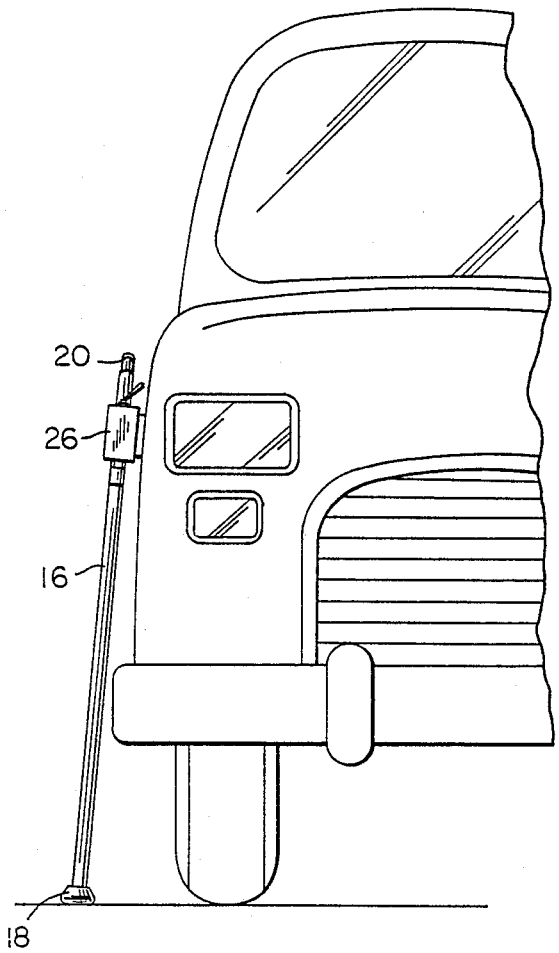
FIG. 2 is an elevational view of a walking cane with the night light of the present invention attached thereto illustrating one advantage of a magnet to secure the cane in an upright position alongside a vehicle.
Figure 3:
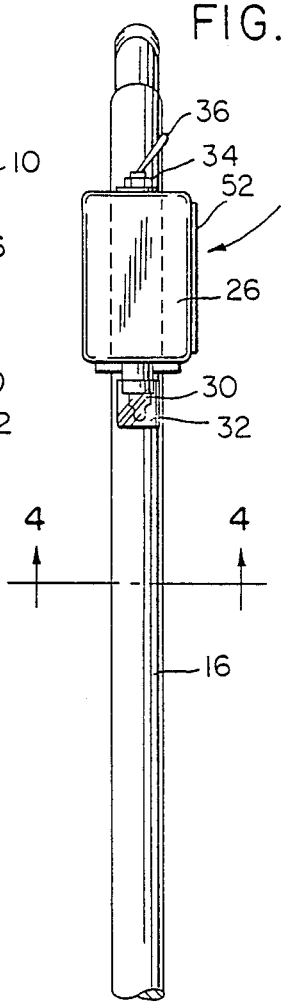
FIG. 3 is a fragmental, front elevational view of the structure of FIG. 1.
Figure 4:
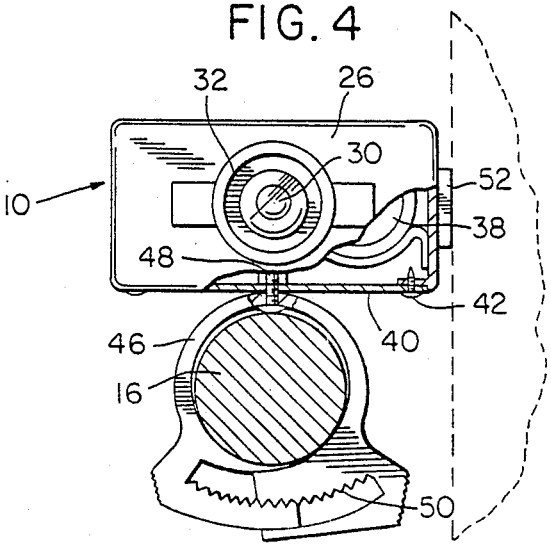
FIG. 4 is a bottom plan view taken along section line 4—4 on FIG. 3 illustrating further structural details of the night light including the clamp structure securing it to the cane and illustrating the association of a magnet to a ferrous surface.
Figure 5:
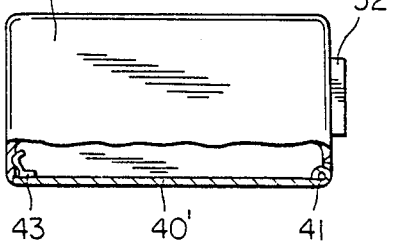
FIG. 5 is a plan view with a portion of the housing shown in section illustrating a backing plate that is pivotally mounted to the housing to provide access to the batteries which power the night light.

The upper end of the housing 26 is provided with a toggle switch 34 having an elongated actuating lever 36 which forms a long throw toggle switch for turning the light on and off. As illustrated in FIGS. 2 and 3, the long throw toggle switch lever 36 is positioned immediately adjacent the handle or handgrip 20 so that a person using the cane and having his hand on the handgrip or handle 20 is provided easy access to the toggle switch lever 36. Also, the long throw toggle switch enables the light to be turned on and off with a reduced force thus enabling handicapped and elderly persons to easily find or locate the toggle switch lever and then actuate the lever. Interiorly of the housing 26, a battery or batteries 38 are positioned for connection with the light bulb 30 through the switch 34 in a conventional and well-known manner. In order to enable removal and replacement of the batteries 38, the housing 26 includes a removable backing plate 40 secured in position by screw threaded fasteners 42. As an alternative, as illustrated in FIG. 5, the housing 26' may be provided with a backing plate 40' having one edge secured pivotally to the housing 26' by a hinge structure 41 and the opposite edge releasably secured in closed position by a friction latch structure 43. This structure facilitates replacement of the batteries without requiring the use of a screw driver or other tool or remove the backing plate 40 by removing the screw threaded fasteners 42 as illustrated in FIG. 4.

The clamps 28 are of conventional construction and generally include a circular body of plastic material 46 having a central portion secured to the backing plate 40 by screw threaded fasteners 48 or the like. The free ends of the clamp 46 are circumferentially telescoped with facing surfaces including inner engaging ridges as indicated by numeral 50. This type of clamp is conventional and a commercially available product. It is pointed out that other types of clips, clamps, brackets or the like may be utilized to secure the night light to the cane, crutches or walker. The housing 26 including the backing plate may also be constructed of plastic, metal or the like and the toggle switch, light bulb and light bulb socket are also conventional and commercially available products. The transparent shield may be constructed of transparent material such as plastic or an unbreakable glass.

One problem which exists with walking assistance devices, especially walking canes and crutches, is the storage of such devices when they are not in use. In many instances, a person may temporarily lean the cane or crutches against a supporting surface and the cane or crutch will subsequently fall onto the supporting surface thus making it quite difficult to retrieve. FIG. 2 illustrates an example of this problem. If a person using a walking cane is carrying an article such as a bag of groceries in one hand and must unlock a vehicle door or open the vehicle door with the other hand, that person will usually lean the cane against the side of the vehicle. Since the vehicle frequently has curved surfaces, the cane will frequently fall onto the ground surface thus requiring that the person using the cane bend over to retrieve it which, in some instances, can be a difficult task. In order to avoid this problem, the housing 26 is provided with a permanent magnet 52 in the form of a tape adhesively secured to the side wall of the housing. Various types of permanent magnets may be utilized in combination with the housing and may be attached thereto in any suitable manner. With the magnet associated with the housing, the cane can be effectively retained in an upright position alongside a vehicle as illustrated in FIG. 2 or alongside a refrigerator or other appliance or device constructed of ferrous material thereby retaining the walking assistance device in desired position during periods of non-use, especially during temporary periods of non-use.

Any type of light source including standard flashlight bulbs may be used along with various battery and wiring assemblies all encased within the housing. The night light can be permanently attached to the walking assistance device or made for attachment and detachment in relation thereto so that the night light can be used as a portable flashlight if desired. By attaching the night light to the cane or other walking assistance device, the person using the cane can effectively see where they are going at nighttime without having to carry a flashlight in their hand. This enables one hand to be kept free when only a single hand is occupied on the cane, crutch or walker or in the event two crutches or two canes are used, this enables the light to be properly positioned and eliminates the possibility of dropping a flashlight and not being able to retrieve it. The night light will be quite light in weight and will not cause unbalance of a walking cane. In addition to lighting the way for the user of the night light, it also enables others such as vehicle operators to more readily see a person walking in the dark. The night light effectively illuminates irregularities in the terrain or surface area being traversed by a person walking at night with the aid of a cane, crutches, a walker or the like by illuminating cracks or offset areas as well as curbs along a sidewalk and the like. In addition to being attachable to walking assistance devices, the night light may also be attached to wheelchairs or other mobile devices in which it is desirable to provide illumination arrangements for use at night.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A night light for attachment to a walking assistance and sports devices having a support member, said night light comprising a housing, means mounting the housing on said support member, a light bulb mounted externally on the housing with the periphery and one end being exposed, said bulb facing an area to be illuminated, battery means in the housing, switch means on the housing for selectively connecting the battery means to the light bulb with the switch means including an actuator oriented externally of the housing for access, said support member including handle means engaged by the user of the walking assistance and sports devices with the switch actuator being disposed adjacent the handle to enable a person using the walking assistance and sports devices by gripping engagement with the handle to reach and manipulate the switch actuator, a transparent shield of cylindrical configuration disposed in encircling relation to the periphery of the light bulb and beyond the end of the light bulb to protect the bulb and enable light rays to pass radially through the shield and out the end of the shield, said shield being provided with an open end to provide access to the light bulb, and means connecting the shield to the housing to enable removal of the bulb when the light bulb is to be replaced.

2. The structure as defined in claim 1 wherein said switch means is a toggle switch, said actuator being an elongated lever to form a long throw toggle switch to enable a user having an arthritic condition or other condition to operate the switch with minimum force.

3. The structure as defined in claim 1 together with magnet means mounted on the housing for securing the night light and walking assistance device to which it is attached against a metal surface.

4. The structure as defined in claim 3 wherein said magnet means is in the form of an elongated strip magnet secured to the housing by adhesive.

5. A night light combined with a device having a support member, said night light including a housing, battery means in said housing connected with an external light through a switch, said switch having an actuator disposed externally of said housing for enabling access thereto to manipulate said switch to illuminate an area adjacent the housing, and means securing said housing to said support member, said external light including a light bulb, said light bulb having a peripheral wall from which light rays emanate radially and axially, a transparent shield encircling the light bulb for protecting the bulb, said transparent shield having an open end to enable access to the light bulb for replacement, said shield being cylindrical to enable radial and axial passage of light rays, said housing including magnetic means to support articles therefrom and to retain said housing and support member against a metal surface.

* * * * *